US007040203B1

(12) United States Patent
Chistiano

(10) Patent No.: US 7,040,203 B1
(45) Date of Patent: May 9, 2006

(54) LATCH DISENGAGEMENT TOOLS

(76) Inventor: George Chistiano, 6592 Humboldt Ave., Westminster, CA (US) 92683

( * ) Notice: Subject to any disclaimer, the term of this patent is extended or adjusted under 35 U.S.C. 154(b) by 0 days.

(21) Appl. No.: 10/754,228

(22) Filed: Jan. 9, 2004

(51) Int. Cl.
*B25B 27/00* (2006.01)

(52) U.S. Cl. ..... 81/488; 81/3.55

(58) Field of Classification Search ..... 81/15.9, 81/488, 3.55
See application file for complete search history.

(56) References Cited

U.S. PATENT DOCUMENTS 3,664,211 A * 5/1972 McConnell ..... 81/15.9
3,705,430 A * 12/1972 Ziaylek, Jr. ..... 7/147
3,885,478 A * 5/1975 Evans ..... 81/3.55
4,926,537 A * 5/1990 Pool ..... 29/275
5,018,409 A * 5/1991 Bittel ..... 81/3.55
5,150,505 A * 9/1992 Drabek ..... 29/278
5,440,954 A * 8/1995 Stevens ..... 81/15.9
5,459,917 A * 10/1995 Smith ..... 29/426.5
5,573,291 A * 11/1996 Raupp et al. ..... 294/1.1
5,620,448 A * 4/1997 Puddu ..... 606/87
5,758,916 A * 6/1998 Raupp et al. ..... 294/1.1
5,988,712 A * 11/1999 Segelin ..... 292/346
6,168,218 B1 * 1/2001 Raupp et al. ..... 294/1.1
6,354,174 B1 * 3/2002 Korwin ..... 81/3.55
6,360,637 B1 * 3/2002 Weinraub ..... 81/488
6,464,370 B1 * 10/2002 Ulicny ..... 362/119

* cited by examiner

*Primary Examiner*—David B. Thomas
(74) *Attorney, Agent, or Firm*—Dennis W. Beech

(57) ABSTRACT

The latch disengagement tools may be used for disengaging a latch of a closure barrier. A tool may be a bar having a tooth and a heel at a latch end. The tooth may have a sloped front edge.

6 Claims, 1 Drawing Sheet

LATCH DISENGAGEMENT TOOLS

BACKGROUND OF THE INVENTION

This invention relates to devices that may be used to open latches and locks of doors, gates and other closure barriers. The new latch disengagement tools may facilitate the pushing back of a latch of a locked closure barrier to allow opening of the barrier such as a door.

Various locksmith tools may have been in use for unlocking closure barriers such as doors, gates and the like. A tool for use in unlocking doors of automobiles may be commonly referred to as a Slim Jim. The tool may be a flat bar structure formed of spring steel that is thin enough to fit between a window and a car door window opening. The tool may be inserted into the door to engage the door lock mechanism to unlock the lock. This type of tool may not be well suited for use in unlocking mechanisms used for doors on buildings or other structures or for gates.

SUMMARY OF THE INVENTION

The present invention is directed to tools for disengaging a latch of a closure barrier. A tool may be a bar having a tooth and a heel at a latch end. The tooth may have a sloped front edge.

These and other features, aspects and advantages of the present invention will become better understood with reference to the following drawings, description and claims.

DETAILED DESCRIPTION

The following detailed description represents the best currently contemplated modes for carrying out the invention. The description is not to be taken in a limiting sense, but is made merely for the purpose of illustrating the general principles of the invention.

Figure 1:
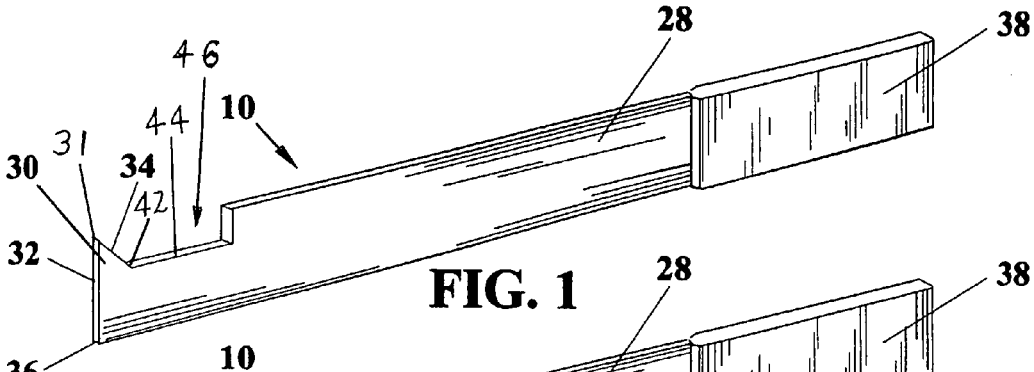
FIG. 1 illustrates a perspective view of a tool according to an embodiment of the invention.
Figure 5:
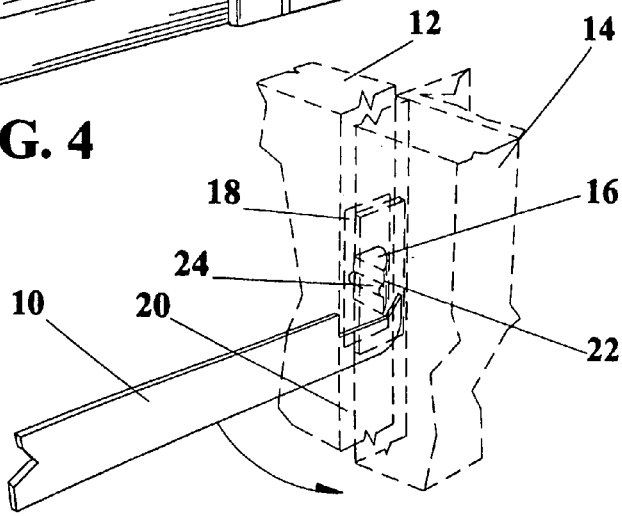
FIG. 5 illustrates a perspective view of a portion of a door and a door jamb with a door latch engage by a tool according to an embodiment of the invention.

Referring to FIGS. 1 and 5, a latch disengagement tool 10 may be a thin bar 28 shape formed of a generally rigid material that may be spring steel, composite material or the like. The tool 10 may be approximately 12 inches long, 1¼ inches wide and 0.030 inches thick. Other lengths, widths and thicknesses may be used depending on the type of door 12, door jamb 14 and latch 16 that may need to be manipulated to open a door. While the term door or gate may be used in the disclosure it should be understood to apply generally to closure barriers, such as, doors and gates, that may use a bolt latching type mechanism an example of which may be illustrated in FIG. 5.

The tool 10 may have a tooth 30 or protrusion formed approximately at a corner at a latch end 32. The tooth 30 may have a sloped front edge 34 at an acute angle relative to a tip 31. The sloped front edge 34 may terminate opposite the tip 31 at a base end 42 at an elongated edge 44 of a recessed portion 46 of the bar 28. The recessed portion 46 may be sufficient length to position the tooth 30 behind the latch 16. In use, the tool 10 may be inserted between a door edge 20 and a door jamb 14 to position the front edge 34 behind the latch 16 on a sloped end 22. This may also serve to position the tooth 30 behind a latch locking pin 24. The tool 10 may be rotated at a handle end 38 to engage a heel 36 formed at approximately an opposed corner at the latch end against the door jamb 14. This may provide leverage to push the latch 16 into the latch mechanism 18 to allow opening of the door 12. In the event there may not be a door jamb 14 element behind the latch 16, the tool 10 may be pulled against the latch 16 to force the latch 16 into the latch mechanism 18.

Figure 2:
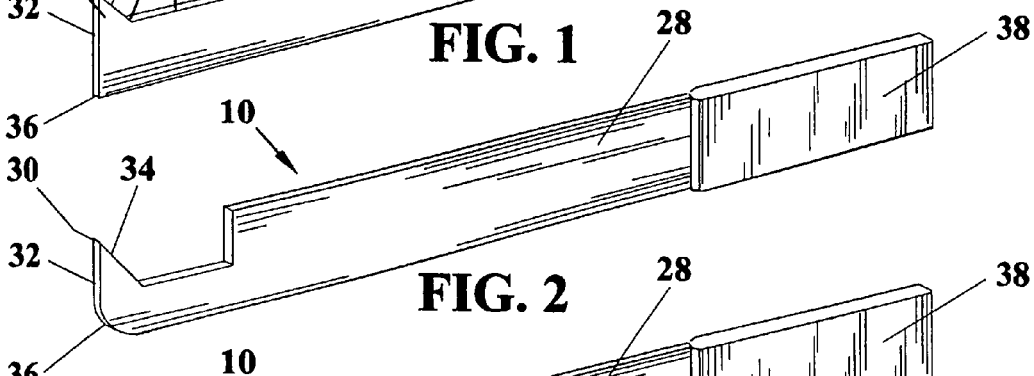
FIG. 2 illustrates a perspective view of a tool according to an embodiment of the invention.
Figure 3:
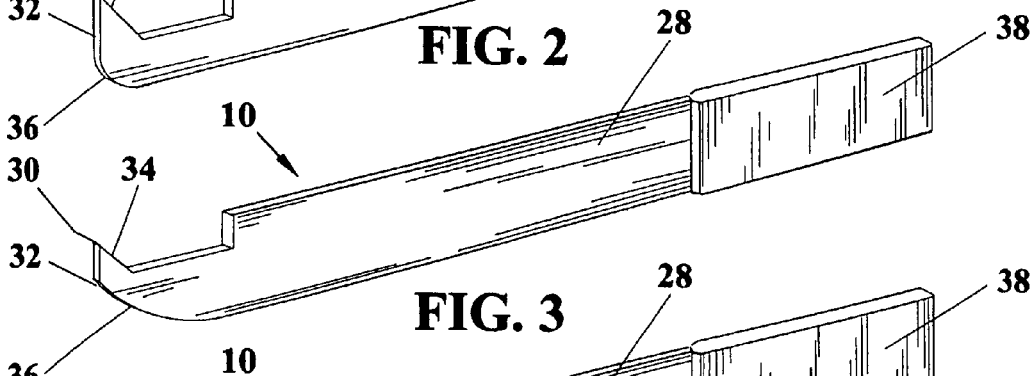
FIG. 3 illustrates a perspective view of a tool according to an embodiment of the invention.

Referring to FIGS. 1 through 3, the heel 36 of the tool may be modified in shape to provide a shorter or longer lever arm effect when the tool 10 is rotated against a door jamb 14. This may also allow the tool 10 to be inserted in various locations where the latch 16 to door jamb 14 clearance space depends on the construction of the door 12 and door jamb 14.

Figure 4:
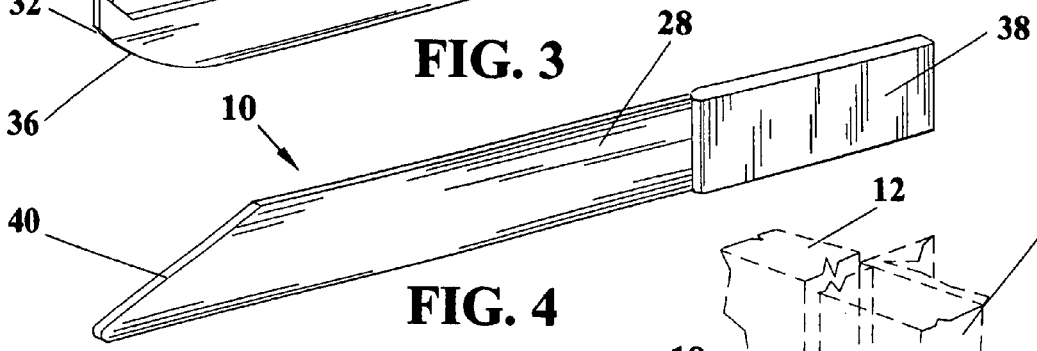
FIG. 4 illustrates a perspective view of a tool according to an embodiment of the invention.

Referring to FIG. 4, the tool 10 may have a wedge shape end 40. This may allow the tool 10 to be inserted with the longitudinal axis generally parallel to a gate or door end to push a latch 16 into the latch mechanism 18.

While the invention has been particularly shown and described with respect to the illustrated embodiments thereof, it will be understood by those skilled in the art that the foregoing and other changes in form and details may be made therein without departing from the spirit and scope of the invention.

I claim:

1. A tool for disengaging a latch of a closure barrier comprising:

a bar having a tooth and a heel located at opposed corners at a latch end;

said heel formed as a right angle intersection of a latch end edge and a bar side edge;

said tooth having a sloped front edge at an acute angle relative to a tip; and said sloped front edge extending linearly from said tip and terminating opposite said tip at an elongated edge of a recessed portion of said bar wherein said elongated edge is of sufficient length for disposal of said tooth behind a latch.

2. The tool as in claim 1 wherein said bar having a handle end.

3. The tool as in claim 1 wherein the bar is formed of spring steel.

4. The tool as in claim 1 wherein said bar is a generally linear, flat construction.

5. A method for disengaging a latch of a closure barrier comprising:

inserting a tool between a door edge and a door jamb wherein said tool having a general bar shape with a tooth and a heel located at opposed corners at a latch end and said tooth having a sloped front edge;

engaging said tooth with a latch of said door; and rotating said tool to engage said heel against said door jamb for leverage to push said latch into a latch mechanism.

6. A tool for disengaging a latch of a closure barrier comprising:

a bar having a tooth and a heel located at opposed corners at a latch end;

said tooth having a sloped front edge; and said bar is approximately 12 inches long, 1.25 inches wide and 0.030 inches thick.

* * * * *

UNITED STATES PATENT AND TRADEMARK OFFICE

CERTIFICATE OF CORRECTION

PATENT NO. : 7,040,203 B1
APPLICATION NO. : 10/754228
DATED : May 9, 2006
INVENTOR(S) : George Christiano It is certified that error appears in the above-identified patent and that said Letters Patent is hereby corrected as shown below:

Title page, item [76] inventor should read – George Christiano --

Signed and Sealed this

Twenty-second Day of August, 2006

JON W. DUDAS
*Director of the United States Patent and Trademark Office*